United States Patent [19]

Delaney

[11] 4,047,641

[45] Sept. 13, 1977

[54] LIQUID DISPENSING CONTAINERS WITH CUTTER FOR PREVENTING REFILLING

[75] Inventor: Francis Alfred Delaney, Formby, England

[73] Assignee: Sinanan Enterprises Limited, London, England

[21] Appl. No.: 625,378

[22] Filed: Oct. 24, 1975

[51] Int. Cl.[2] ..... B65D 47/02; B65D 49/12

[52] U.S. Cl. ..... 222/80; 215/14; 220/86 NR

[58] Field of Search ..... 222/23, 80, 85, 87, 222/86, 147, 153, 562; 215/14, 30; 220/86 NR

[56] References Cited

U.S. PATENT DOCUMENTS

| | | | |
|---|---|---|---|
| 2,822,964 | 2/1958 | Shore | 222/562 X |
| 3,118,288 | 1/1964 | Small | 222/85 X |
| 3,529,750 | 9/1970 | Baumann et al. | 222/153 X |

FOREIGN PATENT DOCUMENTS

| | | |
|---|---|---|
| 1,339,341 | 12/1973 | United Kingdom |

*Primary Examiner*—Robert B. Reeves
*Assistant Examiner*—Francis J. Bartuska
*Attorney, Agent, or Firm*—Berman, Aisenberg & Platt

[57] ABSTRACT

A bottle or like container of relatively hard material such as glass is provided with a readily destructible neck extension portion of relatively soft plastics material. A dispensing optic for screwing into the neck extension has a cutter or cutters arranged to be projected from their retracted state, by the first operation of the optic after insertion into the neck extension, into cutting engagement with the wall of such extension. Rotation of the optic with a view of removing it from the bottle automatically causes the cutter or cutters to sever the neck extension to render the bottle unsuitable further with a dispensing optic and thus prevents re-filling of the bottle with an inferior product and the dispensing of such product through a dispensing optic.

8 Claims, 4 Drawing Figures

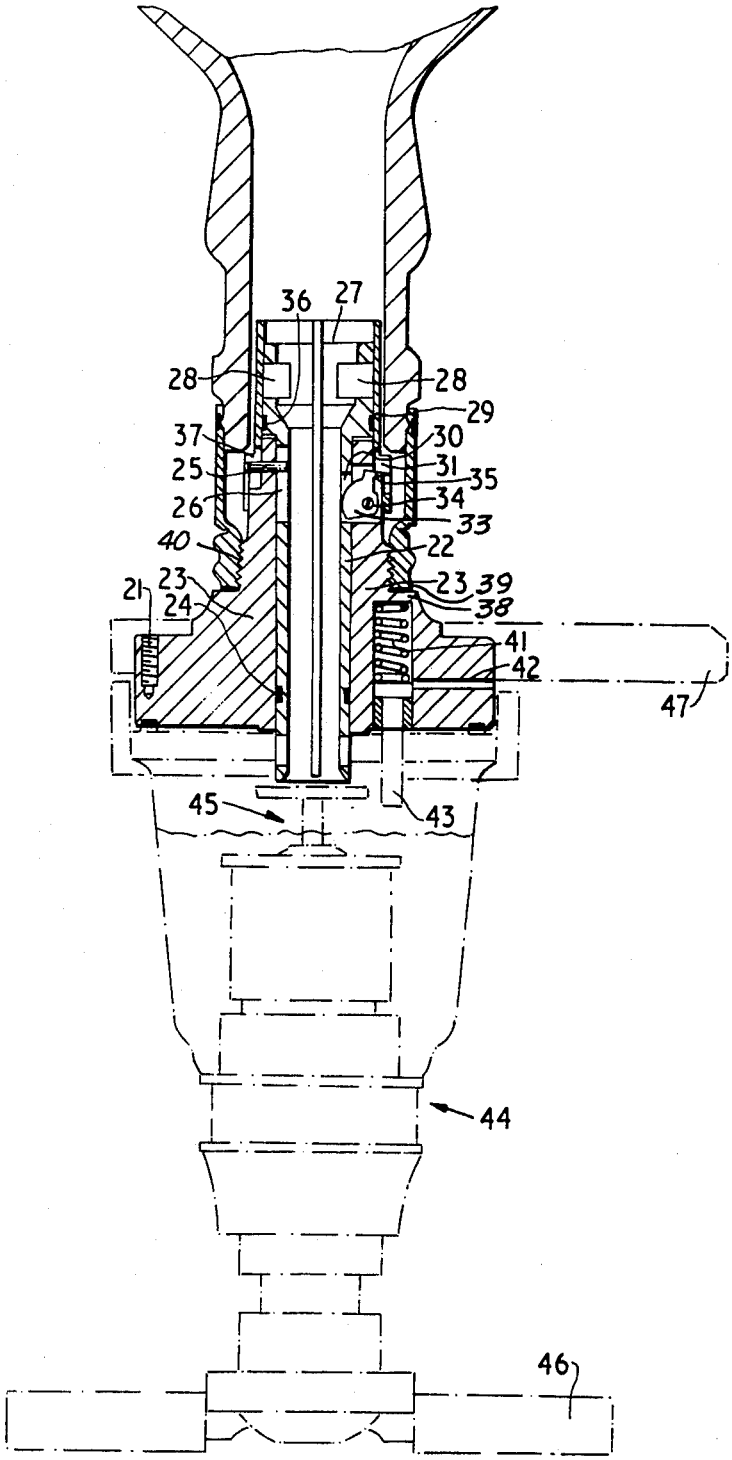
-FIG. 3.-

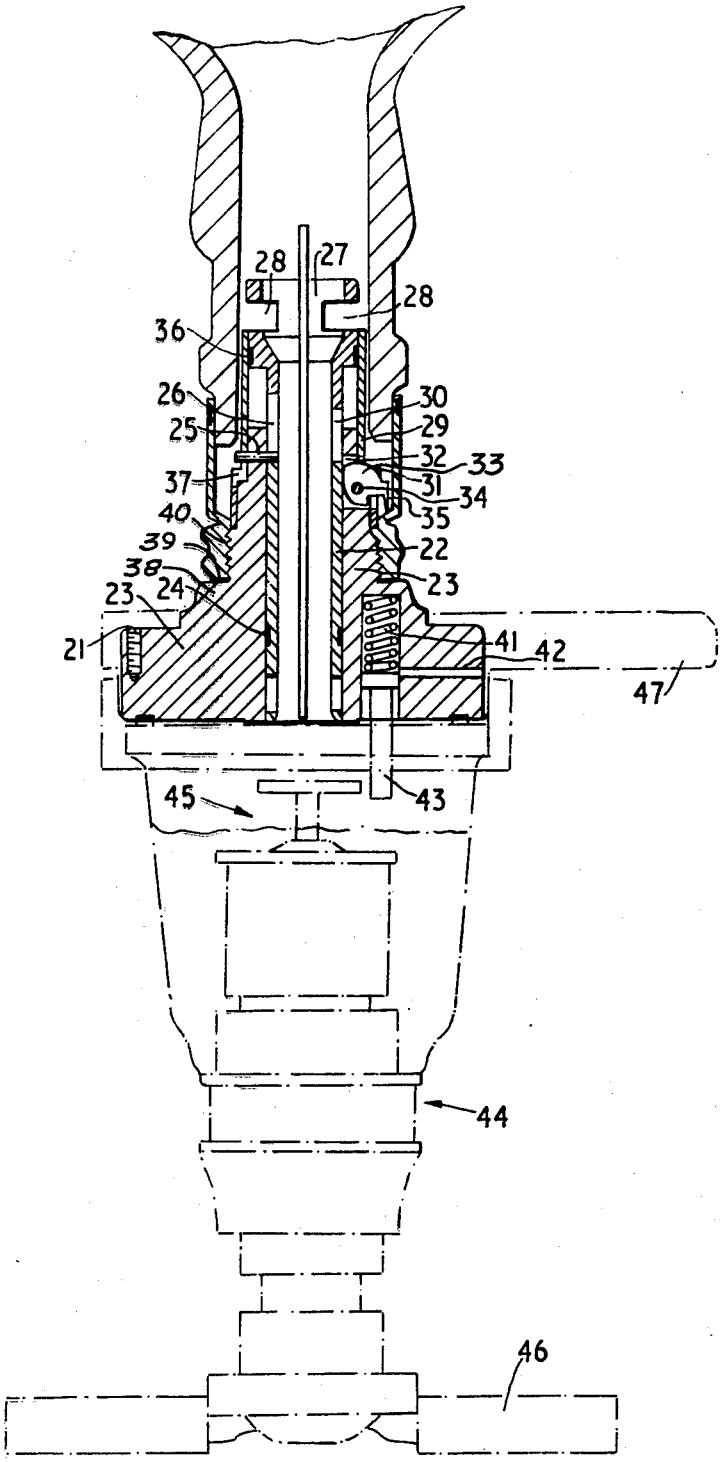
—FIG. 4—

LIQUID DISPENSING CONTAINERS WITH CUTTER FOR PREVENTING REFILLING

BACKGROUND OF THE INVENTION

1. Field of the Invention

The present invention relates to containers for storing liquids and to such containers, hereinafter termed bottles, adapted for co-operation with liquid measuring and dispensing optics in a manner which ensures that the bottles cannot readily be refilled once an optic has been inserted in the neck and operated to dispense liquid from the bottle.

2. Description of the Prior Art

It has previously been proposed in British Pat. Specification No. 1,339,341 to provide a dispensing optic with cutting means for insertion into the neck of a bottle such that any attempt to remove the dispensing means results in damage to the neck of the bottle to render it further unusable with the optic. In this known arrangement, the cutters which damage the neck of the bottle are arranged to be displaced radially outwardly, upon operation of the optic, into an operative state so that any attempt to remove the optic after it has been operated results in the cutters engaging the material of the neck and damaging it. As it is necessary in an arrangement of this kind to provide an adequate liquid flow passage from the bottle into the optic, in addition to accommodating the cutters and actuating arrangements therefor, the use of radially displaceable cutters necessitated the use of an exceptionally wide neck for the bottle to avoid over restriction of the liquid flow passage, and thus the arrangement was only satisfactorily applicable to specially designed bottles.

SUMMARY OF THE INVENTION

It is an object of the invention to overcome the abovementioned drawbacks of known arrangements thereby enabling the same advantages to be attained with a bottle of conventional size and shape.

To this end the invention contemplates providing an improved form of bottle consisting essentially of a conventional glass bottle with an extension neck-piece of softer plastics material having an inwardly directed shoulder formation for co-operation with a cutter arrangement in which the cutters are pivotable between retracted and operative states to thereby leave room for an adequate flow passage through the cutter arrangement when positioned in the neck extension piece. The cutter arrangement itself forms a union or junction piece between the bottle and a dispensing optic of otherwise conventional construction and provides for pivotal displacement of the cutters into a operative state in response to operation of th optic to dispense a measured quantity of liquid from the bottle.

Thus according to the invention there is provided a bottle having a main body part and a neck part integral with said body part made of glass or like hard and rigid material and an extension neck piece of a softer plastics material fixedly secured in liquid tight manner at one end to said neck part of the bottle, said extension piece being externally screw-threaded at its other end to cooperate with a closure cap and having an inwardly directed shoulder formation between its ends and spaced from the outer end of the neck portion of the bottle.

The outer of end of neck extension piece is internally screw threaded and the cutting device, with the cutters held retracted, is screwed into such end of the extension piece and a dispensing optic, attached to the outer end of the cutting device, is thus positioned for co-operation with the bottle. When the optic is first operated to dispense a measured quantity of the liquid contents of the bottle, a member of the optic which is longitudinally displaced during such operation co-operates with a member of the cutting device to pivot the cutters out of their retracted positions into projecting positions in which they engage, or are only slightly displaced from, the shoulder formation of the extension neck piece, and the lock the cutters in such projecting state. As a result, any attempt to remove the optic and cutting device by unscrewing it from the bottle, for the purpose of refilling the bottle, results in the cutters cutting through the soft plastics material of the shoulder formation thereby damaging the neck piece in such a way that the optic cannot be respositioned in relation to such neck piece for useful operation.

The use of a neck extension piece of soft plastics material secured to the neck of an otherwise conventional glass bottle facilitates the effective destruction of the bottle by means of cutters of less robust construction than would by required to damage the glass neck of the bottle and the pivotal displacement of the cutters between retracted and projecting states enables the cutters to be accommodated within the neck extension piece while leaving an adequate liquid flow passage through the cutting device without the need for an exceptionally wide neck piece. As a result the cutting arrangements can be incorporated in an optic of conventional size or coupled to such an optic and used with a bottle of conventional shape and size.

BRIEF DESCRIPTION OF THE DRAWINGS

The various features and advantages of the invention will be apparent from the following description of a preferred embodiment thereof given by way of example and illustrated in the accomanying drawings in which:

FIG. 3 shows in section the bottle neck of FIG. 1 with a cutting device inserted in the extension piece prior to operation of the optic, and FIG. 4 is a view similar to that of FIG. 3 after the optic has been operated to dispense liquid from the bottle.

DESCRIPTION OF THE PREFERRED EMBODIMENTS

Figure 1:
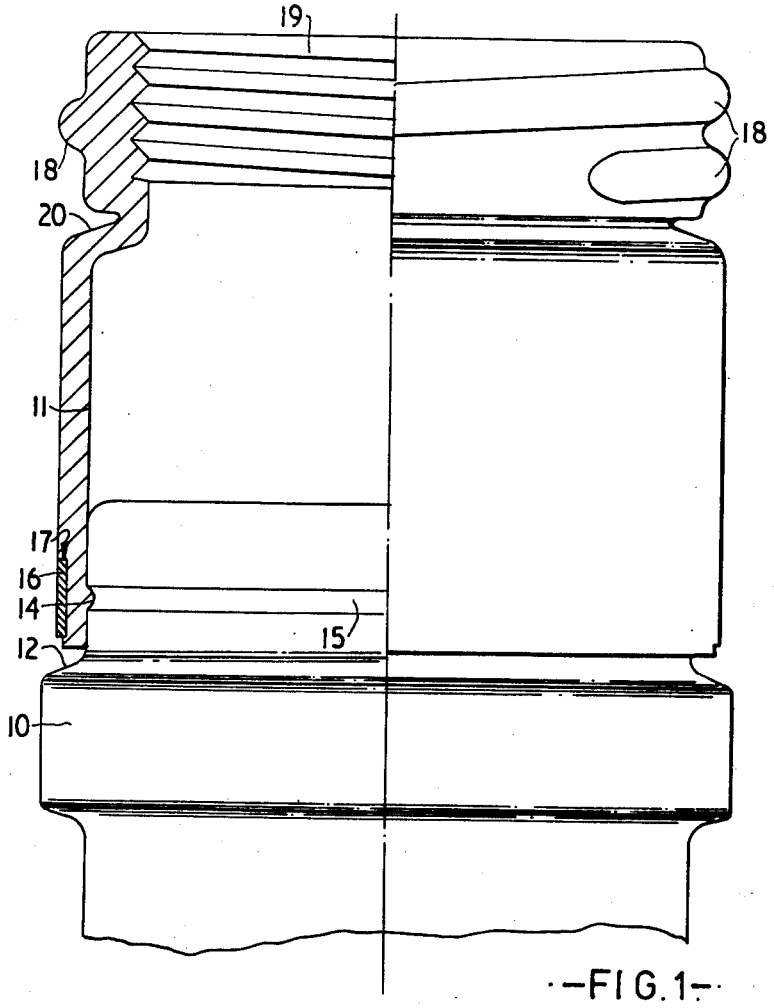
FIG. 1 is a part sectional view of the neck of a glass bottle with the neck extension piece secured thereto.
Figure 2:
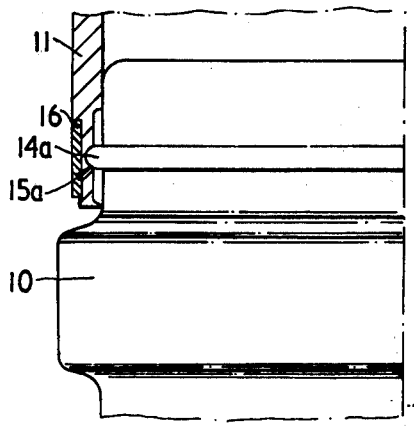
FIG. 2 shows in section a detail modification of part of FIG. 1.

Referring first to FIG. 1, there is shown the neck part 10 of a conventional glass bottle used for containing spirits, the precise shape of which does not affect the invention and is therefore not shown. The neck part 10 is formed with a shoulder 12 beyond which the mouth of the neck part is provided with an annular groove 15. Instead of a groove the mouth of the neck part may be provided with an annular bead 15*a* as shown in FIG. 2. Secured on to the mouth of the neck part is a neck extension piece 11 of synthetic plastics material suitable for use in container for alcoholic liquids, for example methylpentene polymers (TPX). The extension piece 11 is externally screw-threaded at 18 to receive a closure cap and is internally screw-threaded at 19 to receive a cutting device and optic. Beneath the screw threads 18 and 19 the extension piece 11 has an inwardly directed shoulder formation 20. Towards its opposite end the extension piece has an inwardly facing bead 14 which fits into the groove 15. Alternatively, as shown in FIG. 2, the extension piece 11 may have an annular groove 14*a,* in place of the bead 14, to receive the bead 15*a* on the bottle neck. An annular recess 17 is formed in the outer surface of extension piece 11 in register with the bead 14 (FIG. 1) or the groove 14*a* (FIG. 2) and a closed metal ring 16 is positioned in recess 17 and shrunk for example by a magnetic-pulse forming operation so as to compress the material of the extension piece into intimate sealing engagement with the outer surface of the mouth part of the neck portion 10. This shrinking on of the ring may conveniently be effected using the MAGNEFORM apparatus and process.

The bottle with its extension neck piece attached in fluid-tight manner may be filled with liquid and capped and sealed in conventional manner for storage and transportation.

When it is desired to dispense the contents of such a bottle by means of a measuring and dispensing optic the closure cap is removed and an optic incorporating the cutting device is screwed into the mouth of the neck extension piece, the bottle is inverted, and the optic operated.

The bottle of FIG. 1 with the cutting device and optic in position is illustrated in FIGS. 3 and 4 and details of the cutting device will now be described with referene to these figures.

In FIGS. 3 and 4 the measuring and valving arrangements of the optic itself, as distinct from the cutting device incorporated in it, are assumed to be of conventional construction and are not shown in detail. Such a conventional optic, indicated at 44, has arms 46 against which a drinking glass or the like is pressed to move such arms and the interior valving mechanism of the optic upwardly and cause liquid from a measuring chamber within the optic to flow into the drinking glass in known manner. Upon release of the upward pressure on the arms 46 the valving mechanism moves downwardly to admit liquid from the bottle into the measuring chamber. In the course of such upward movement of the valving arrangements within the optic for the first time after its insertion into the bottle neck, a liquid outlet tube 22 slidably arranged in the upper body part 23 of the optic and which serves as an actuator for the cutting arrangements, is displaced upwardly from the position shown in FIG. 3 to the position shown in FIG. 4 and remains in this position until the optic is removed from the bottle as will later be described.

The tube 22 is made a friction fit in the central bore of the body part 23 by means of an elastic ring 24 seated in a groove formed in the outer surface of tube 22 and the extent of longitudinal displacement of tube 22 in body 23 is limited by one end of a pin 25 projecting from the wall of the bore in body 23 and engaging in a longitudinal slot 26 in the wall of tube 22. At its upper end tube 22 terminates in a head 27 having a number of ports 28 through which liquid in the bottle can enter the tube and air to replace such liquid can pass into the bottle. In the state shown in FIG. 3 these ports are covered by a sleeve 29 surrounding the head 27 and which has a limited sliding movement on the upper end of body part 23 which it also surrounds. The limits of the sliding movement of sleeve 29 are set by the opposite end of pin 25 projecting from the body part 23 into a slot 37 in sleeve 29. The head 27 is made a friction fit in the bore of sleeve 29 by means of a elastic ring 36 seated in a groove formed in the outer surface of head 27. The tube 22 has three recesses 30, and the sleeve 29 has three apertures 31 both equally spaced around the circumferences of the tube and sleeve, which recesses and apertures, in the state of the device shown in FIG. 3, register with slots 32 in the body part 23. Three cutters 33 are mounted on pivots 34 in slots 32 so that the cutters, in their retracted state, are each accommodated in a chamber constituted by a recess 30, a slot 32, and an aperture 31. The cutters 33 each have a cutting tooth part 35 which, in the retracted state, lies under the upper edge of an aperture 31 and is held within the sleeve 29 by the material of sleeve 29 lying below the lower edge of aperture 31. In a preferred form the tooth part 35 of each cutter 33 is of metal and is set in the main body of the cutter which is in the form of a disc of synthetic plastics material.

Body part 23 is formed with a shoulder 38 on which a resilient sealing washer 39 is seated and above shoulder 38 the body part is externally screw-threaded at 40 to co-operate with the internal screw-threading 19 of the mouth of the bottle neck extension piece 10.

An air inlet valve 41 communicating with the exterior of the optic through a bore 42 and actuable by a plunger 43 is mounted in a bore in the body part 23 in such a way that the plunger 43 is raised to open the valve each time the valving arrangements within the optic 44 are raised upon operation of the optic to dispense a quantity of liquid.

The optic and cutter device with the cutters in the retracted state is screwed into the neck extension piece of the bottle and tightened on the sealing washer 39 to make a liquid tight seal and the bottle is then inverted and mounted in a suitable support stand (not shown) by means of a mounting bracket 47 secured to the body part 23 by screws such as 21 and the parts are then in the relative positions shown in FIG. 3.

Upon first operating the optic 44 to dispense a quantity of liquid from the bottle by presenting a drinking glass to the arms of the optic and pressing upwardly, the valving arrangements within the optic, which are not shown in detail but are indicated in chain dotted lines as including a slider arrangement 45, are moved upwardly, and the arrangement 45 raises tube 22 relative to body part 23 and also displaces plunger 43 to open to air inlet valve 41. As tube 22 is raised the lower edge of recess 30 acting upon the disc body part of each cutter 33 causes each cutter to rotate about its pivot pin 34 and in so doing causes the nose part 35 of each cutter to disengage from its slot 31 in sleeve 29 and pivot outwardly to assume the position shown in FIG. 4. During this pivoting movement each cutter 33 engages the lower surface of a slot 31 in sleeve 29 and pushes sleeve 29 downwardly against the frictional resistance afforded by ring 36. Also during this pivoting movement the flat base surface of the body of each cutter 33 on the opposite side of pivot 34 to nose parts 35, is engaged by the outer surface of tube 22 below recess 30 and each cutter is thus firmly held in the extended position shown in FIG. 4 by such engagement and the engagement of a surface leading to the nose 35 with the base of slot 31 in sleeve 29. Due to the friction grip exerted by ring 24 between the tube 22 and the wall of the bore in the body part 23, the tube 22 remains in the raised position shown in FIG. 4 after the first actuation of the optic and the cutting points of the noses 35 of cutters 33 press against or abut the inner surface of the shoulder 20 of the bottle neck extension piece 10.

To remove the optic from the bottle it is necessary to unsrew it to disengage threads 40 and 19 and as this is done the cutters 33 cut deeper and deeper into the material of shoulder 20, finally parting the material and destroying the extension neck piece 10. Thus the bottle with part only of the extension neck piece 10 secured to it is rendered unsuitable for further use with an optic. To prepare the optic for use with another bottle having a complete neck extension piece 10 pressure is applied to the head 27 of tube 22 to force the tube back through the bore in body part 23 against the frictional resistance afforded by ring 24 and at the same time sleeve 29 is displaced against the frictional resistance afforded by the ring 36 towards its opposite limiting position with respect to body part 23. As soon as tube 22 has moved sufficiently to bring recess 30 into register with the upper ends of the base surfaces of cutters 33 the sleeve 29 in its displacement begins to pivot the cutters back into their retracted state in the chambers defined by recesses 30 and slots 31 and 32. Upon completion of such retraction of the cutters the portions of the sleeve 29 below the slots 31 hold the retracted cutters in their chambers.

The body part 23 and associated parts shown in detail in FIGS. 3 and 4 may be incorporated in an otherwise conventionally constructed optic or it may be formed as a separate unit to be assembled with the measuring and valving arrangements of a conventional optic as a unitary structure before insertion into the neck of a bottle.

For details of the construction of a conventional optic reference may be made to the following British Pat. Specifications Nos. 532,530; 720,127 and 862,166.

I claim:

1. A bottle like container having a main body part and a neck part integral with said body part made of glass or like hard and rigid material and an extension neck piece of a softer plastics material fixedly secured in liquid-tight manner at one end to said neck part of bottle or container, said extension piece being externally screw-threaded at its other end to co-operate with a closure cap and having an inwardly directed shoulder formation between its ends and spaced from the outer end of the neck portion of the bottle, wherein said extension piece is internally screw-threaded at the end thereof remote from said bottle neck part and beyond said shoulder formation, having engaged in said internally screw-threaded portion of said extension piece a device operable to cut through the material of said shoulder formation upon rotation thereof relative to said extension piece whereby to sever said internally screw-threaded portion from the remainder of the extension piece upon rotation of said device in operated state, wherein said device includes at least one cutter member pivotally movable between a first position in which said cutter member is retracted into the body of the device and inoperative and a second position in which said cutter member projects from the body of the device for cutting engagement with said shoulder formation.

2. A bottle or container as claimed in claim 1 wherein said extension neck piece is fixedly secured to the neck part of the bottle by means of a closed metal band shrunk on to the extension piece to compress the material of the extension piece into intimate sealing engagement with the outer surface of the bottle neck part.

3. A bottle or container as claimed in claim 2 wherein said bottle neck part is formed with an annular bead in its outer surface and said closed metal band is shrunk onto said extension piece in register with said bead.

4. A bottle or container as claimed in claim 2 wherein said bottle neck part is formed with an annular groove in its outer surface and said closed metal band is shrunk onto said extension piece in register with said groove.

5. A bottle or container as claimed in claim 1 wherein the body of said device has a central bore in which is slidably arranged a tubular member adpated upon sliding movement in said bore to pivotally displace said cutter member between said first and second positions.

6. A bottle or container as claimed in claim 5 wherein said body and said tubular member have co-acting stop means arranged to limit the sliding movement of said tubular member within said bore and said tubular member has slots therein to receive said cutter member into retracted state at the limit of sliding movement of said tubular member in one direction.

7. A bottle or container as claimed in claim 6 wherein said body in the region of said cutter member carries a sleeve member arranged for limited sliding movement with respect to said body and having apertures therein for the passage therethrough of said cutter memeber, said sleeve in one position thereof serving to hold said cutter member in retracted state and said tubular member in one position thereof serving to hold said cutter member in projecting state.

8. A bottle or container as claimed in claim 1 wherein said device further comprises a plurality of cutter members operable in substanitally the same fashion as said at least one cutter member.

* * * * *